US008929766B2

(12) United States Patent
Masuda

(10) Patent No.: US 8,929,766 B2
(45) Date of Patent: Jan. 6, 2015

(54) IMAGE FORMING APPARATUS SEQUENTIALLY OUTPUTTING A SHEET HAVING BEEN SUBJECTED TO IMAGE FORMATION PROCESSING TO A PAPER OUTPUT TRAY

(75) Inventor: Junya Masuda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 279 days.

(21) Appl. No.: 13/521,305

(22) PCT Filed: Nov. 5, 2010

(86) PCT No.: PCT/JP2010/069661

§ 371 (c)(1),
(2), (4) Date: Jul. 10, 2012

(87) PCT Pub. No.: WO2011/092920

PCT Pub. Date: Aug. 4, 2011

(65) Prior Publication Data

US 2012/0301174 A1 Nov. 29, 2012

(30) Foreign Application Priority Data

Jan. 27, 2010 (JP) ..... 2010-015413

(51) Int. Cl.
*G03G 15/00* (2006.01)
*B65H 29/12* (2006.01)

(52) U.S. Cl.
CPC ..... *G03G 15/6573* (2013.01); *B65H 29/125* (2013.01); *B65H 2301/5144* (2013.01); *B65H 2406/122* (2013.01); *B65H 2601/273* (2013.01); *B65H 2801/06* (2013.01); *B65H 2801/09* (2013.01); *G03G 2221/1645* (2013.01); *B65H 2404/513* (2013.01); *B65H 2404/5214* (2013.01); *B65H 2801/27* (2013.01)
USPC ..... 399/92

(58) Field of Classification Search
USPC ..... 399/92
See application file for complete search history.

(56) References Cited

U.S. PATENT DOCUMENTS 7,890,014 B2 * 2/2011 Koshida ..... 399/92

FOREIGN PATENT DOCUMENTS

JP 03-196175 A 8/1991
JP 08-137371 A 5/1996

(Continued)

OTHER PUBLICATIONS

International Search Report for corresponding International Application No. PCT/JP2010/069661 mailed Dec. 14, 2010.

*Primary Examiner* — Quana M Grainger
(74) *Attorney, Agent, or Firm* — Renner, Otto, Boisselle & Sklar, LLP

(57) ABSTRACT

An image forming apparatus capable of effectively cooling down a sheet having been subjected to fixing processing while preventing an apparatus from becoming larger in size and a sheet conveyance failure from occurring is provided. The image forming apparatus (10) includes a sheet conveyance path (16), a fixing device (22), a conveyance roller (26), an upper sheet guide (60), a lower sheet guide (62), and a cooling fan (40). The conveyance roller (26) is disposed downstream of a heat-treatment portion in the sheet conveyance path and configured so as to convey a sheet passing the heat-treatment portion to the paper output tray. At a position corresponding to the position of the conveyance rollers (26), the upper sheet guide (60) is provided with a ventilation portion (604) configured so as to make the cooling air from the cooling device (40) pass through. At a position opposed to the ventilation portion (604) of the upper sheet guide (60), the lower sheet guide (62) is provided with a ventilation portion (624) configured so as to make the cooling air from the cooling device (40) pass through.

8 Claims, 12 Drawing Sheets

(56) References Cited

FOREIGN PATENT DOCUMENTS

| | | | |
|---|---|---|---|
| JP | 08-171338 | A | 7/1996 |
| JP | 09-034321 | A | 2/1997 |
| JP | 11-352840 | A | 12/1999 |
| JP | 2000-075709 | A | 3/2000 |
| JP | 2003-066744 | A | 3/2003 |
| JP | 2006-106668 | A | 4/2006 |

* cited by examiner

IMAGE FORMING APPARATUS SEQUENTIALLY OUTPUTTING A SHEET HAVING BEEN SUBJECTED TO IMAGE FORMATION PROCESSING TO A PAPER OUTPUT TRAY

TECHNICAL FIELD

The present invention relates to an image processing apparatus configured to sequentially output a sheet having been subjected to image formation processing to a paper output tray.

BACKGROUND ART

In some image forming apparatuses such as copiers, a phenomenon has occurred such that the surfaces of the sheets stacked on the paper output tray and lying next to each other have sometimes been adhered to each other by toner. Such a phenomenon is referred to as, for example, a sticking phenomenon. The phenomenon is considered to occur due to toner at a high temperature and in a molten state when the sheet having been subjected to fixing processing is outputted to the paper output tray without being sufficiently cooled down. In particular, the sticking phenomenon has easily occurred at a time of double-sided printing and high-speed printing and at a time of printing in which low melting point toner is used.

As one of means to prevent such a sticking phenomenon from occurring, a device can be designed so that a length of a conveyance path from a fixing device to the paper output tray may be extended. However, in a case where such a design is performed, the design may cause a problem that the device becomes larger in size.

Thus, some conventional techniques propose a technique in which a sheet that has passed through the fixing device is attempted to be cooled down by blowing air by using a cooling fan (refer to Patent Literature 1, for example).

CITATION LIST

Patent Literature

[Patent Literature 1]
Japanese Patent Laid-Open Publication No. 2006-106668

SUMMARY OF INVENTION

Technical Problem

The above-mentioned technique according to the Patent Literature 1, however, employs a structure in which air is blown toward a sheet in a state where the sheet is not sufficiently supported by a roller, so that a sheet conveyance failure (curling up of a sheet, bending of a sheet, a jam, etc.) might occur in the sheet due to the air from the cooling fan.

Additionally, since there is no vent for the air introduced into the sheet conveyance path, the air introduced into the sheet conveyance path is blown towards a sheet guide and may flow backwards to the sheet conveyance path. For this reason, when air is continuously generated from the cooling fan, the sheet conveyance failure (curling up of the sheet, bending of the sheet, a jam, etc.) of a sheet to be conveyed next by the air that flows backwards to the sheet conveyance path might occur.

On the other hand, the cooling fan is switched on/off so as to operate the cooling fan only when a sheet is being passed, which can suppress occurrence of the sheet conveyance failure while causing a problem that the control of operation of the cooling fan becomes complicated and troublesome.

An object of the present invention is to provide an image forming apparatus capable of effectively cooling a sheet having been subjected to fixing processing while preventing the apparatus from becoming larger in size and a sheet conveyance failure from occurring.

Solution to Problem

An image forming apparatus according to the present invention is configured to sequentially output a sheet having been subjected to image formation processing to a paper output tray. This image forming apparatus is provided with a sheet conveyance path, a heat-treatment portion, a pair of conveyance rollers, an inner sheet guide, and a cooling device.

The sheet conveyance path is formed between a paper feed tray and a paper output tray. The heat-treatment portion is configured so that a sheet being conveyed along the sheet conveyance path is heat-treated. Examples of the heat-treatment portion include a fixing device that fixes and fuses an unfixed toner image on a sheet by heat and pressure and a dryer that heats the sheet to dry.

The pair of conveyance rollers is arranged downstream of the heat-treatment portion in the sheet conveyance path, and is configured so that the sheet having passed the heat-treatment portion may be conveyed to the paper output tray. An outer sheet guide and the inner sheet guide are configured so as to define a downstream part of the heat-treatment portion in the sheet conveyance path. The outer sheet guide (an upper sheet guide, for example) and the inner sheet guide (a lower sheet guide, for example) are in the inside of the image forming apparatus.

The cooling device is configured so as to cool down a sheet having been conveyed between the outer sheet guide and the inner sheet guides by cooling air. An example of the cooling device includes a cooling fan.

Furthermore, at a position corresponding to the position of the conveyance rollers, the outer sheet guide is provided with a ventilation portion configured so as to make the cooling air from the cooling device pass through. Additionally, at a position opposed to the ventilation portion of the outer sheet guide, the inner sheet guide is provided with a ventilation portion configured so as to make the cooling air from the cooling device pass through.

In this configuration, by the time when a sheet having passed the heat-treatment portion reaches the paper output tray, the sheet will be cooled down by the cooling air from the cooling device. In addition, since a sheet is designed to be blown by the cooling air while the sheet is held between the conveyance rollers and becomes stable, any trouble to the conveyance of the sheet is less likely to happen due to blowing of the cooling air. Furthermore, since the ventilation portion is provided in the outer sheet guide and the inner sheet guide, respectively, interference with the conveyance of the sheet due to the cooling air introduced in the sheet conveyance path, the cooling air flowing backwards in the sheet conveyance path, is suppressed.

Generally, in a case where the cooling device is operated even when a sheet is not conveyed by the conveyance rollers, the cooling air guided in the sheet conveyance path flows backwards in the sheet conveyance path and thereby may cause a conveyance failure (curling up of a sheet, bending of a sheet, a jam, etc.) in the sheet when a sheet is conveyed next, but such a problem is solved by adopting the above-stated configuration.

Advantageous Effects of Invention

It becomes possible to effectively cool a sheet having been subjected to fixing processing while preventing an apparatus from becoming larger in size and a sheet conveyance failure from occurring.

BRIEF DESCRIPTION OF DRAWINGS

FIG. 10A is a view illustrating a position of a valve member when a sheet passes through a nip line of a driving roller and a driven roller and FIG. 10B is a view illustrating a position of a valve member when a sheet does not pass through a nip line of a driving roller and a driven roller and when a sheet is in a standby state;

DESCRIPTION OF EMBODIMENTS

Figure 1:
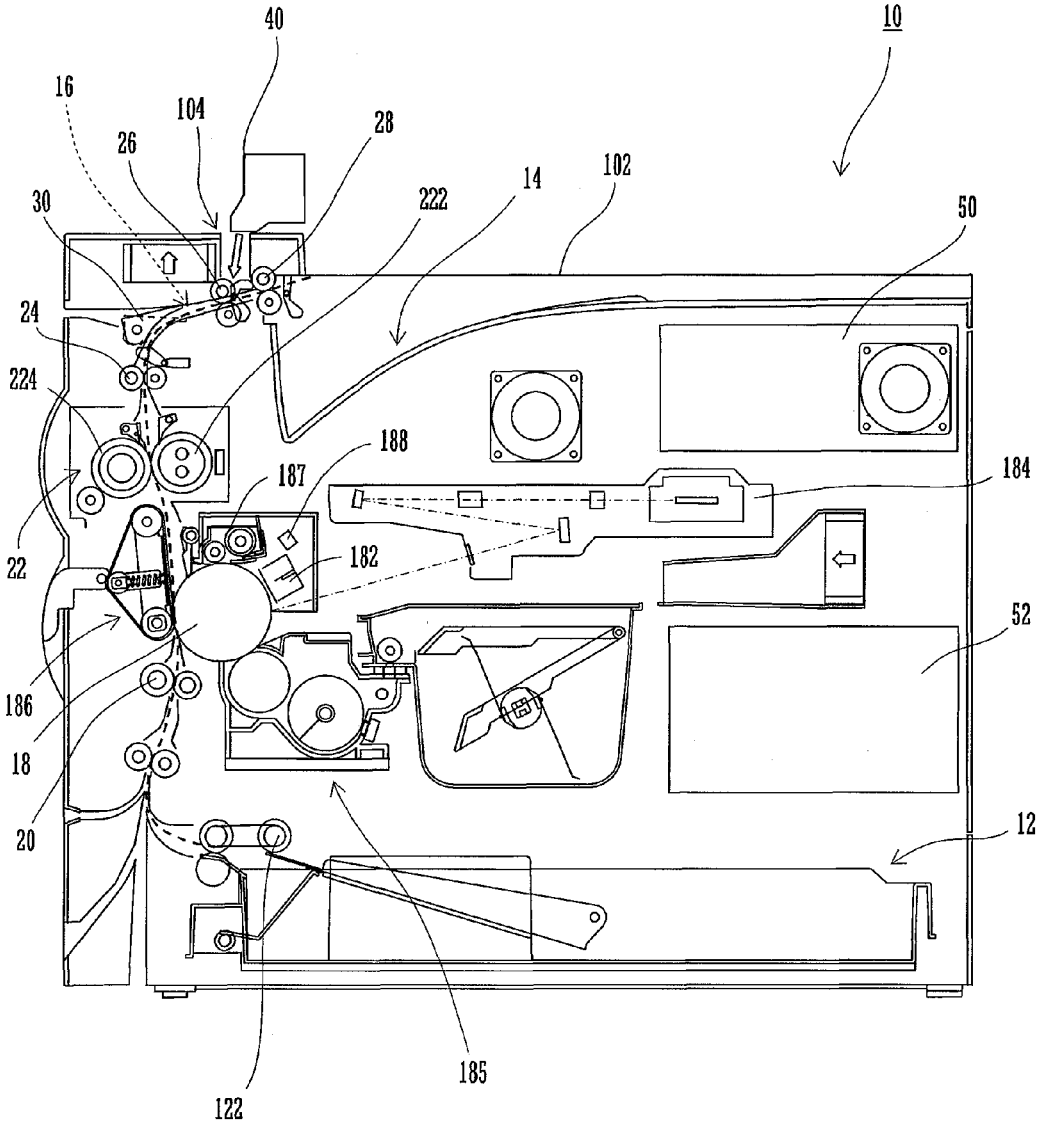
FIG. 1 is a schematic cross-sectional view showing an image forming apparatus according to an embodiment of the present invention.

Referring to FIG. 1, schematic description is made of an image forming apparatus according to an embodiment of the present invention. As shown in the figure above, the image forming apparatus 10 includes a paper feed tray 12 arranged at a lower part thereof, the paper feed tray storing a sheet to be subjected to image formation. On the other hand, the image forming apparatus includes a paper output tray 14 arranged at an upper part thereof, the paper output tray storing a sheet which has been subjected to the image formation and is outputted to outside of the apparatus. A sheet conveyance path 16 extending vertically is formed between the paper feed tray 12 and the paper output tray 14. The paper feed tray 12 is provided with a pick-up roller 122 for sending out stored sheets one by one to the sheet conveyance path 16.

In the vicinity of the sheet conveyance path 16, a photoreceptor drum 18 is arranged. The photoreceptor drum 18 is an image bearing member for bearing an image to be transferred onto a sheet that is conveyed in the sheet conveyance path 16. Around the photoreceptor drum 18, there are arranged a charging device 182, a light scanning unit 184, a developing unit 185, a transfer device 186, a cleaning unit 187, and an electric discharge lamp 188. The charging device 182 charges uniformly on the surface of the photoreceptor drum 18. The light scanning unit 184 scans an optical image on the uniformly charged photoreceptor drum 18 to write an electrostatic latent image. It is to be noted that at the upper part of the light-scanning unit 184 a control portion 50 including a circuit board that controls image formation processing and an interface board that accepts image data from an external device is disposed. On the other hand, at the lower part of the light-scanning unit 184 an electric power portion 52 that supplies electric power to each of the above-stated portions in the image forming apparatus 10 is disposed.

The developing unit 185 supplies developer in a developer supplying container onto the electrostatic latent image formed on the surface of the photosensitive drum 18 and forms a developer image. The transfer device 186 transfers the developer image formed on the surface of the photoreceptor drum 18 to a sheet in the sheet conveyance path 16. Although the transfer device 186 having a transfer belt is shown as an example, the present invention is not limited to this example. For example, a transfer device having a transfer roller can also be used.

The cleaning unit 187 removes the developer that remains on the surface of the photoreceptor drum 18 in order to form a new image on the photoreceptor drum 18. The electric discharge lamp 188 removes the electric charge on the surface of the photoreceptor drum 18.

On the upstream side of the photoreceptor drum 18 in the sheet conveyance path 16, a registration roller 20 is arranged. The registration roller 20 adjusts the timing with which a sheet is guided into an image formation position (a transfer position) formed between the photoreceptor drum 18 and the transfer device 186.

On the downstream side of the photoreceptor drum 18 in the sheet conveyance path 16, a fixing device 22 is arranged. The fixing device 22 is provided with a fixing roller 222 and a pressure roller 224 which are disposed on both sides with the sheet conveyance path 16 held therebetween. The fixing device 22 fixes an unfixed developer image transferred to an image formation surface of a sheet conveyed in the sheet conveyance path 16 onto a sheet by heat and pressure from the fixing roller 222 and the pressure roller 224.

On the downstream side of the fixing roller 222 in the sheet conveyance direction, a post-fixing roller 24, a flapper 30, a conveyance roller 26, and a paper output roller 28 are arranged. The post-fixing roller 24 further conveys the sheet that has passed the fixing device 22 to the downstream of the sheet conveyance path 16. While being configured to be lifted up by being hit by a sheet conveyed by the post-fixing roller 24, the flapper 30 is configured so as to guide a sheet conveyed backwards by the conveyance roller 26 to a not illustrated post-processing device, a switchback conveyance path, or the like.

On a top surface of a housing 102 of the image forming apparatus 10, an opening portion 104 is formed. In the vicinity of the opening portion 104 in the housing 102, a cooling fan 40 which sends cooling air to a sheet to be outputted through the opening portion 104 is provided.

Figure 2:
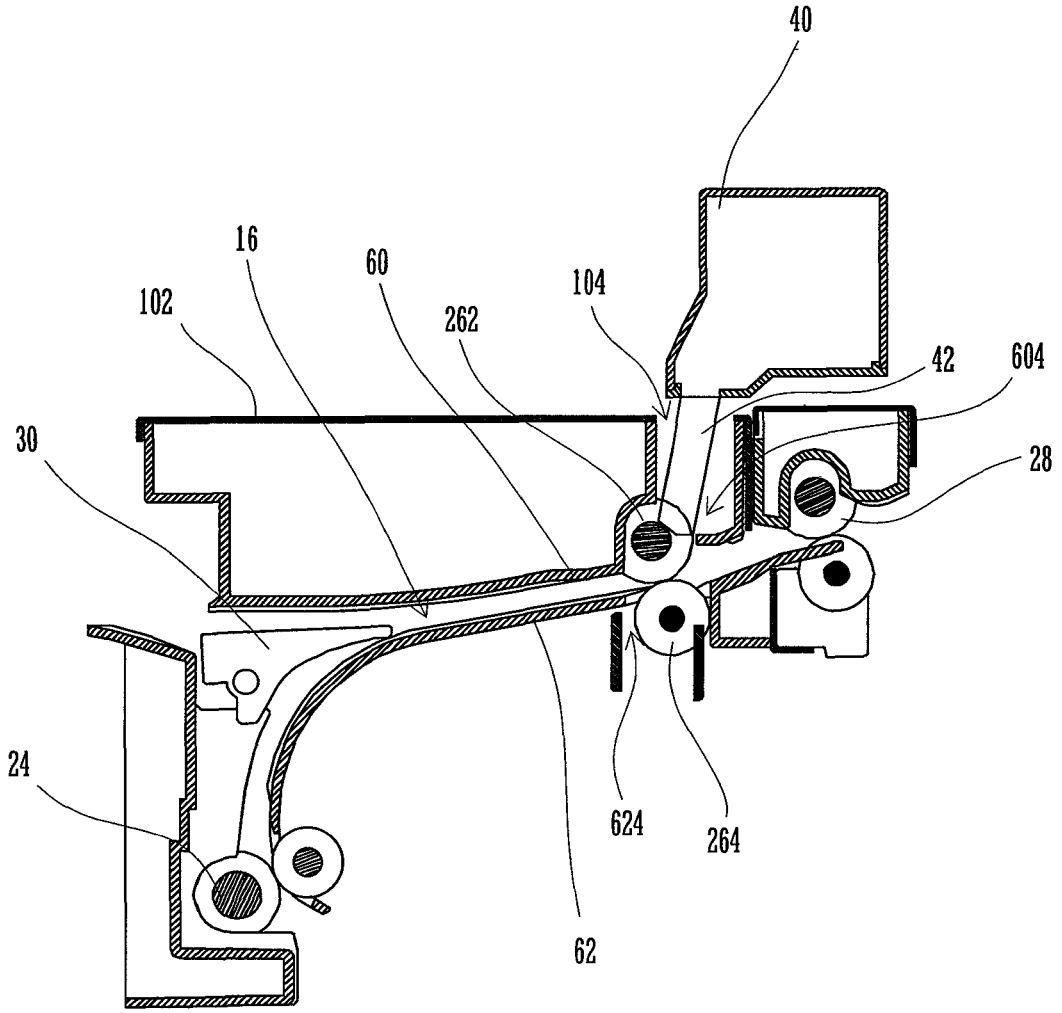
FIG. 2 is a cross-sectional view showing an exemplary configuration of a downstream side of a fixing device in a sheet conveyance path.

Subsequently, referring to FIG. 2, the configuration of the downstream side of the fixing device 22 in the sheet conveyance path 16 is described. As shown in the figure above, a part of the downstream of the fixing device 22 in the sheet conveyance path 16 is defined by the upper sheet guide 60 and the lower sheet guide 62. The lower sheet guide 62 is provided with a plurality of ribs 622 (refer to FIG. 3A and FIG. 4A) along the sheet conveyance direction.

At a position corresponding to the opening portion 104 in the upper sheet guide 60, a ventilation portion 604 for introducing air from the cooling fan 40 into the sheet conveyance path 16 is provided. On the other hand, the cooling fan 40 is provided with a blowing duct 42 configured so as to extend to the vicinity of the ventilation portion 604 of the upper sheet guide 60. Further, at a position opposed to the ventilation portion 604 in the lower sheet guide 62, a ventilation portion 624 for letting air from the cooling fan 40 pass through the lower part of the sheet conveyance path 16 is provided. Although the ventilation portion 604 and the ventilation portion 624 are preferably configured, for example, by providing a meshed part, by providing a lot of small holes, or by providing a plurality of slits in the upper sheet guide 60 and the lower sheet guide 62, respectively, there is no limitation to these configurations.

Subsequently, referring to FIG. 3, the configuration of the vicinity of the conveyance roller 26 in the sheet conveyance path 16 is described. As shown in the figure above, the conveyance roller 26 is configured by a driven roller 264 disposed in the upper part thereof and a driving roller 262 disposed in the lower part thereof.

The ventilation portion 604 of the upper sheet guide 60 and the ventilation portion 624 of the lower sheet guide 62 are disposed in the width to which air from the blowing duct 42 of the cooling fan 40 is blown. In addition, in this arrangement, a nip line of the driving roller 262 and the driven roller 264 is disposed in the width to which air from the blowing duct 42 of the cooling fan 40 is blown. Here, the nip line means a virtual line that is drawn so that a nip portion of the driving roller 262 and the driven roller 264 is extended in an axial direction.

Figure 3A:
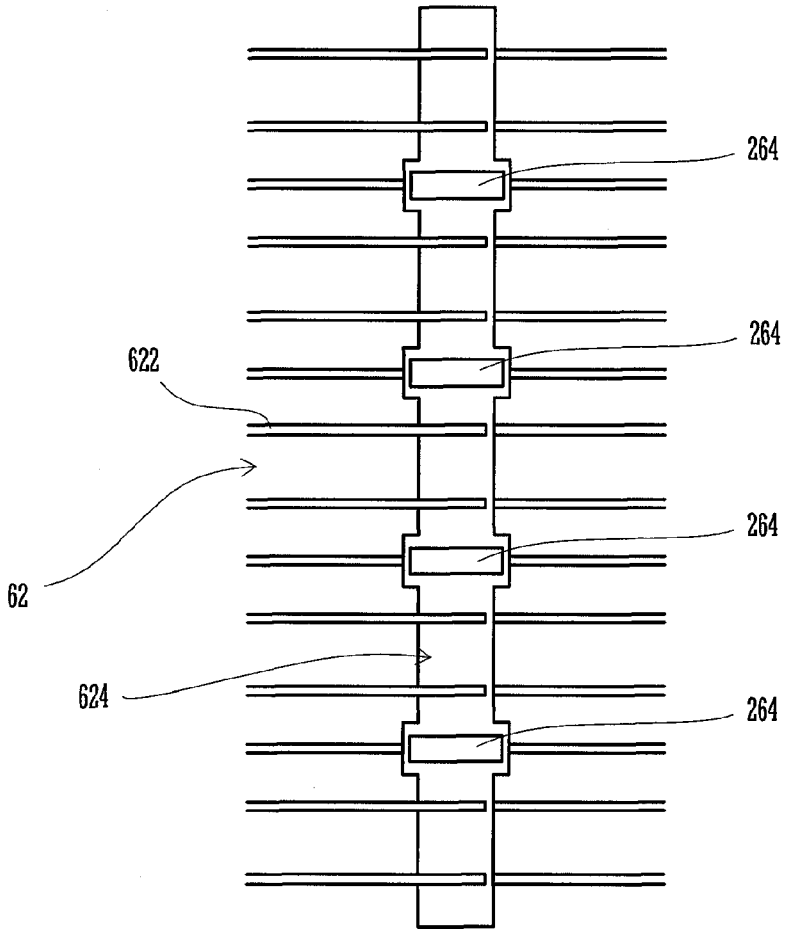
FIG. 3A is a plan view showing an example of a configuration in a vicinity of a conveyance roller in a sheet conveyance path.
Figure 3B:
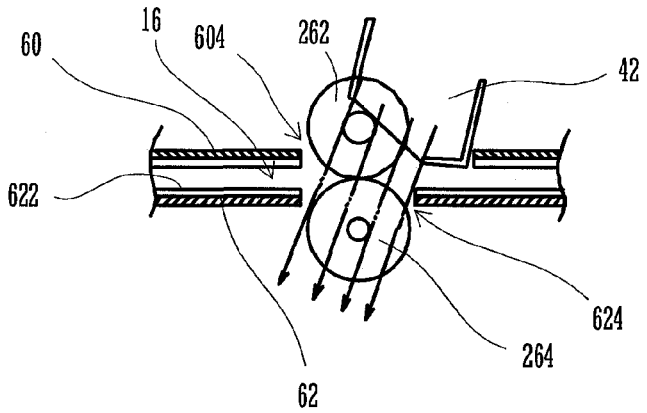
FIG. 3B is a cross-sectional view showing an example of a configuration in a vicinity of a conveyance roller in a sheet conveyance path.

In the image forming apparatus 10, by adopting a configuration as shown in FIG. 3A and FIG. 3B, a sheet having passed through the fixing device 22 is cooled down by the cooling air from the cooling fan 40 by the time when the sheet reaches the paper output tray 14. For this reason, when the sheet is outputted to the paper output tray 14, it becomes possible to prevent a sticking phenomenon and the like from occurring since the toner on the sheet is cooled down and adhered. Further, a sheet is blown by the cooling air when the sheet is stably held between the driving roller 262 and the driven roller 264, so that malfunctions such as a conveyance failure in the sheet by being blown by the cooling air are unlikely occur.

Additionally, even when the sheet does not pass and even when air is continuously sent out to the sheet conveyance path 16 from the cooling fan 14, since the air that advances into the sheet conveyance path 16 may pass downward through the ventilation portion 624, the cooling air does not blow backward in the sheet conveyance path 16 and has no adverse effects on the conveyance of a following sheet.

Moreover, since a plurality of ribs 622 are provided in the lower sheet guide 62 and since air is blown to a recess portion between the ribs 622 even if only slight air blows backward in the sheet conveyance path 16, adverse effects are unlikely to occur to the conveyance of a sheet to be subsequently conveyed.

By adopting the above mentioned configurations, the ON/OFF switching control of the cooling fan 40 becomes unnecessary and no problem occurs even though the cooling fan 40 is continuously being operated. For this reason, a control such as to make the cooling fan 40 being operated according to a conveyance timing of a sheet becomes unnecessary.

It is to be noted that the cooling fan 40 is preferably disposed on a side opposed to the fixing device 22 with the sheet conveyance path 16 held therebetween. This is because the cooling air generated from the cooling fan 40 is unlikely to reach the fixing device 22, and the fixing device 22 is prevented from being unnecessarily cooled down by the cooling air.

Figure 4A:
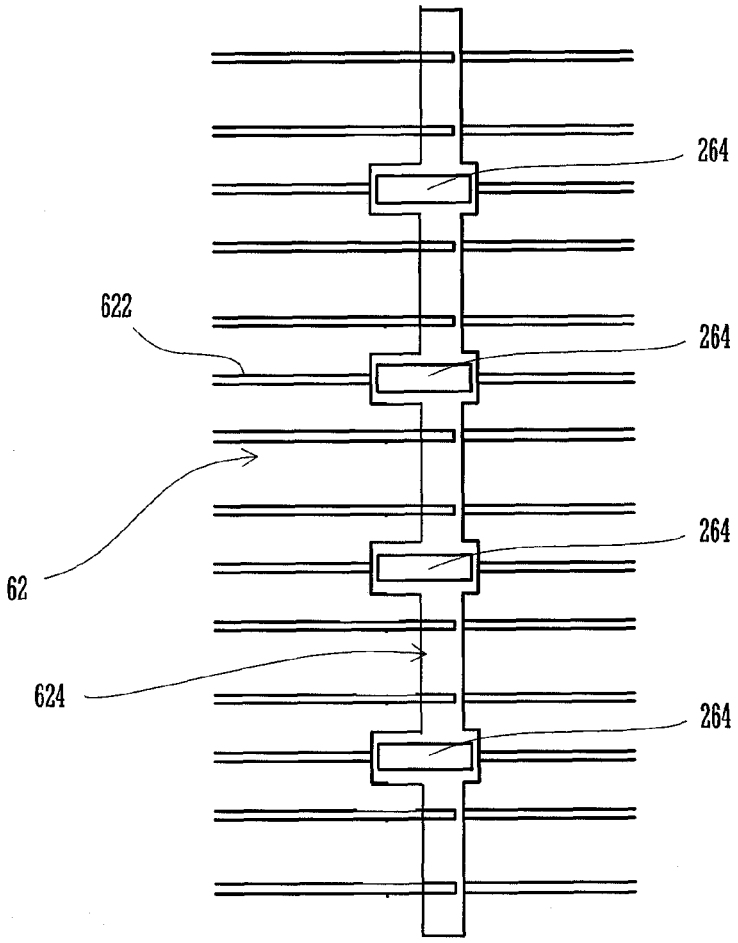
FIG. 4A is a plan view showing another example of a configuration in a vicinity of a conveyance roller in a sheet conveyance path.
Figure 4B:
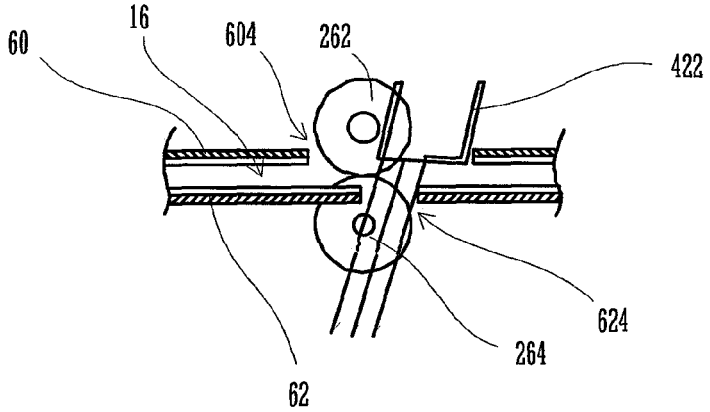
FIG. 4B is a cross-sectional view showing another example of a configuration in a vicinity of a conveyance roller in a sheet conveyance path.

Subsequently, referring to FIG. 4A and FIG. 4B, variation of the configuration of the vicinity of the conveyance roller 26 in the sheet conveyance path 16 is described. In the configuration shown in FIG. 3A and FIG. 3B, although the nip line of the driving roller 262 and the driven roller 264 is disposed in the width to which air is blown from the blowing duct 42 of the cooling fan 40, here, a configuration allows air from the blowing duct 42 of the cooling fan 40 to pass through a position slightly deviated to the downstream side.

In other words, the nip line of the driving roller 262 and the driven roller 264 is disposed in the sheet conveyance path 16 more upstream than in the width to which air is blown from the blowing duct 42 of the cooling fan 40. By adopting such a configuration, before a sheet is held between the driving roller 262 and the driven roller 264, it becomes possible to surely prevent occurrence of a conveyance failure (curling up of the sheet, bending of the sheet, a jam, etc.) of the sheet due to curling up of the sheet and the like by the cooling air.

Subsequently, referring to FIG. 5, the configuration in which a part more upstream than the driving roller 262 and the driven roller 264 in the sheet conveyance path 16 is preliminarily cooled down by using the cooling air that has passed through the ventilation portion 624 of the lower sheet guide 62 is described.

Figure 5:
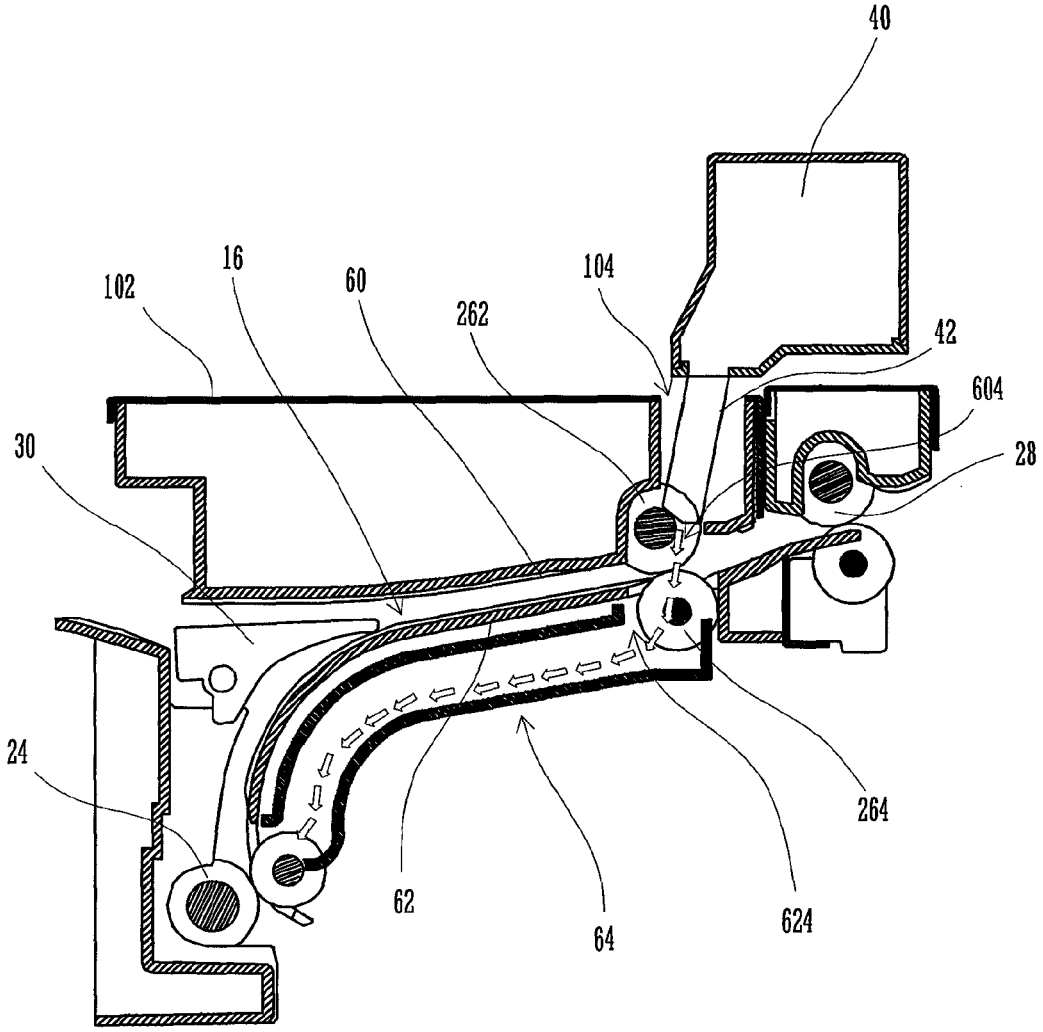
FIG. 5 is a cross-sectional view showing another exemplary configuration of a downstream side of a fixing device in a sheet conveyance path.

In the configuration shown in FIG. 5, a guide duct 64 that is configured so that the cooling air that has passed through the ventilation portion 624 of the lower sheet guide 62 may be guided to the post-fixing roller 24 is provided. Therefore, while the sheet has not passed through the nip line of the driving roller 262 and the driven roller 264, the cooling air from the cooling fan 40 passes through the guide duct 64 and is guided to the post-fixing roller 24. For this reason, the cooling air from the cooling fan 40 plays a role to cool down a sheet to be conveyed while the sheet passes through the nip line of the driving roller 262 and the driven roller 264, and plays a role to preliminarily cool down the post-fixing roller 24 while the sheet does not pass through the nip line of the driving roller 262 and the driven roller 264. Therefore, when the sheet having passed the fixing device 22 contacts the post-fixing roller 24, the sheet temperature is easily lowered. Furthermore, the heat resistance of the post-fixing roller 24 does not need to be very high, and the toner of the sheet becomes difficult to adhere to the post-fixing roller 24.

Since the cooling air is blown to a sheet also in the nip line of the post-fixing roller 24, it becomes possible to cool down the sheet that has passed the fixing device 22 more effectively, and, as a result, the toner on the sheet more easily and quickly adheres to the sheet.

Subsequently, referring to FIG. 6 and FIG. 7, another example of the configuration in which a part more upstream than the driving roller 262 and the driven roller 264 in the sheet conveyance path 16 is preliminarily cooled down by using the cooling air that has passed through the ventilation portion 624 of the lower sheet guide 62 is described.

Figure 6:
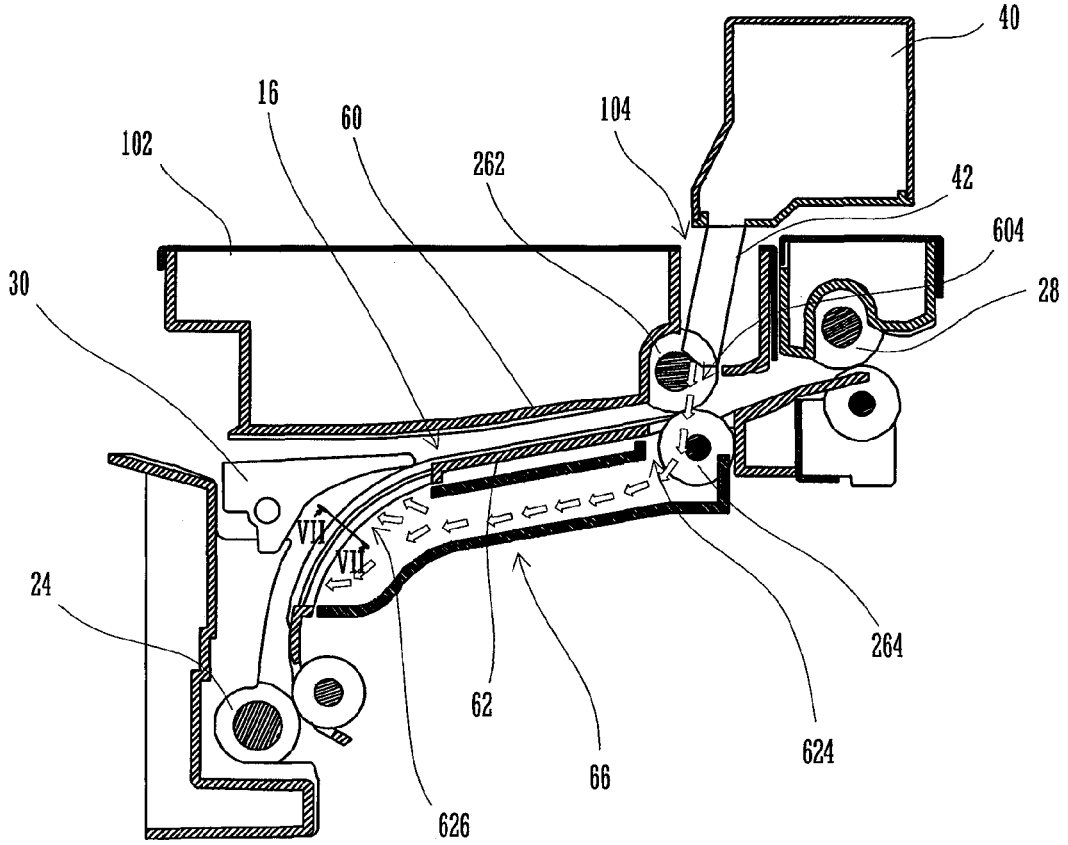
FIG. 6 is a cross-sectional view showing another exemplary configuration of a downstream side of a fixing device in a sheet conveyance path.
Figure 7:
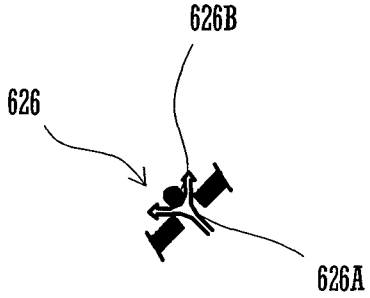
FIG. 7 is a VII-VII line cross-sectional view in FIG. 6.

In the configuration shown in FIG. 6 and FIG. 7, a guide duct 66 that is configured so that the cooling air that has passed through the ventilation portion 624 of the lower sheet guide 62 may be guided to a cooling portion 626 provided upstream of the ventilation portion 624 in lower sheet guide 62 is provided. As a part to which the cooling air is guided, it is preferred to introduce air near the leading edge of the flapper 30.

This cooling portion 626 includes a plurality of slits 626A that are formed in the widthwise direction perpendicular to the sheet conveyance direction (the direction perpendicular to the plane of the figures) and a rib-like member 626B disposed so as to cover the slit 626A. These slits 626A and the rib-like member 626B can be formed, for example, by a molding metal mold having a "pinch off" structure. Since the rib-like member 626B of the cooling portion 626 is cooled down by the cooling air, the temperature of the lower sheet guide 62 is prevented from going up and the sheet in contact with the rib-like member 626B can easily radiate heat. In addition, toner becomes difficult to attach to the rib-like member by maintaining the rib-like member in contact with a sheet at low temperature.

Since the flow rate of the cooling air that passes through the slit of the cooling portion 626 is reduced as compared with the flow rate of the cooling air that passes through the ventilation portion 624 of the lower sheet guide 62, a sheet conveyance failure by the cooling air is unlikely to occur. Furthermore, in the cooling portion 626, in order that the rib-like member may divide the cooling air that passes through the slit, the cooling air does not flow strongly into the sheet conveyance path 16. Moreover, since the cooling air that has passed through the slit can escape out of the device through a clearance to the flapper 30 and the surroundings thereof, the air that has passed through the cooling portion 626 does not flow backwards in the sheet conveyance path 16.

Figure 8:
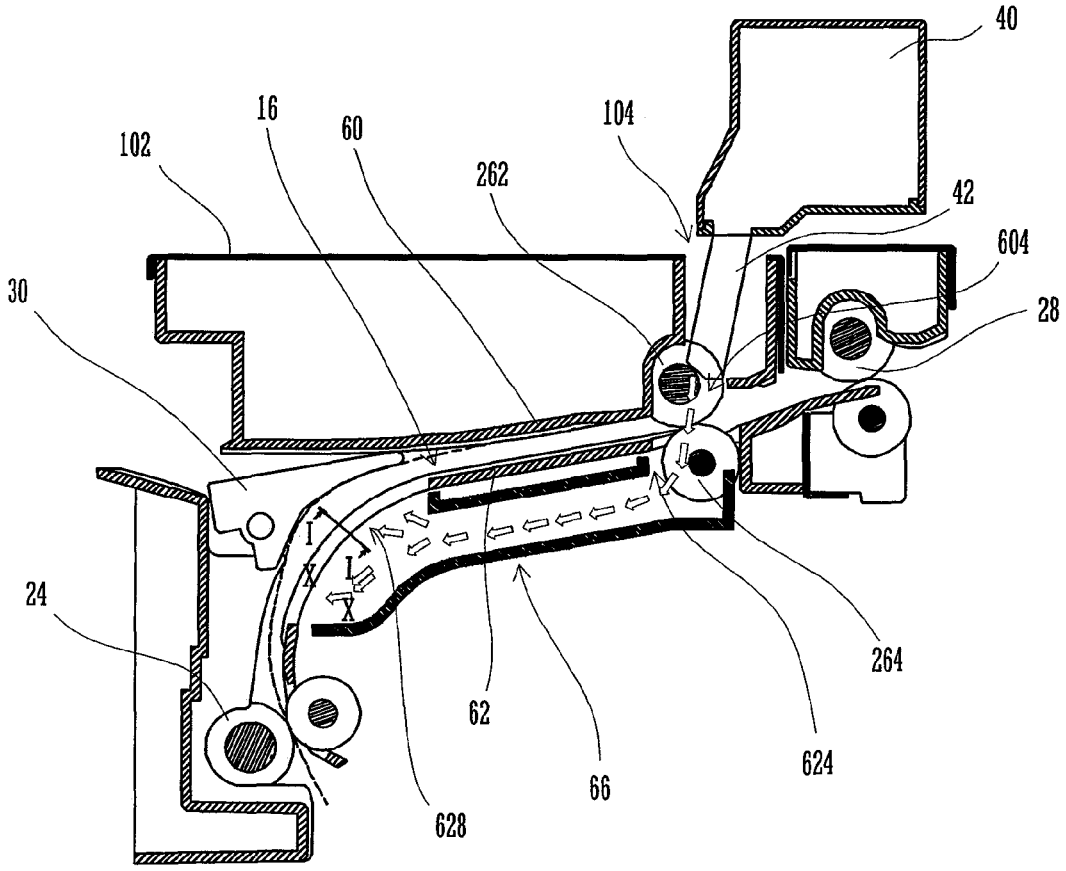
FIG. 8 is a cross-sectional view showing another exemplary configuration of a downstream side of a fixing device in a sheet conveyance path.
Figure 9:
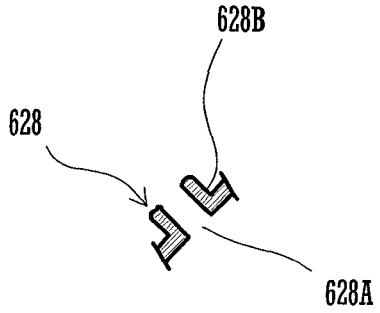
FIG. 9 is an IX-IX line cross-sectional view in FIG. 8.

Additionally, in the lower sheet guide 62, in place of the above-described cooling portion 626, a cooling portion 628 as shown in FIG. 8 and FIG. 9 may be provided. As shown in FIG. 9, the cooling portion 628 includes a plurality of slits 628A that are formed in the widthwise direction (the direction perpendicular to the plane of the figure) and ribs 628B that are formed on the both sides of each of the slit, respectively. As a part to which the cooling air is guided, the periphery of the leading edge of the flapper 30 is also preferred here.

Figure 10A:
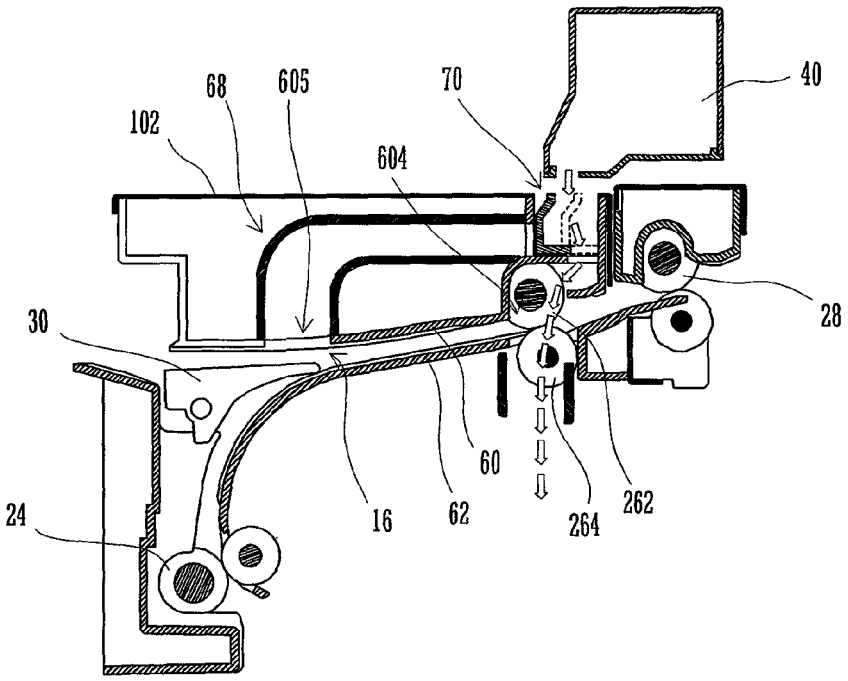
FIGS. 10A and 10B are cross-sectional views showing another exemplary configuration of a downstream side of a fixing device in a sheet conveyance path.
Figure 10B:
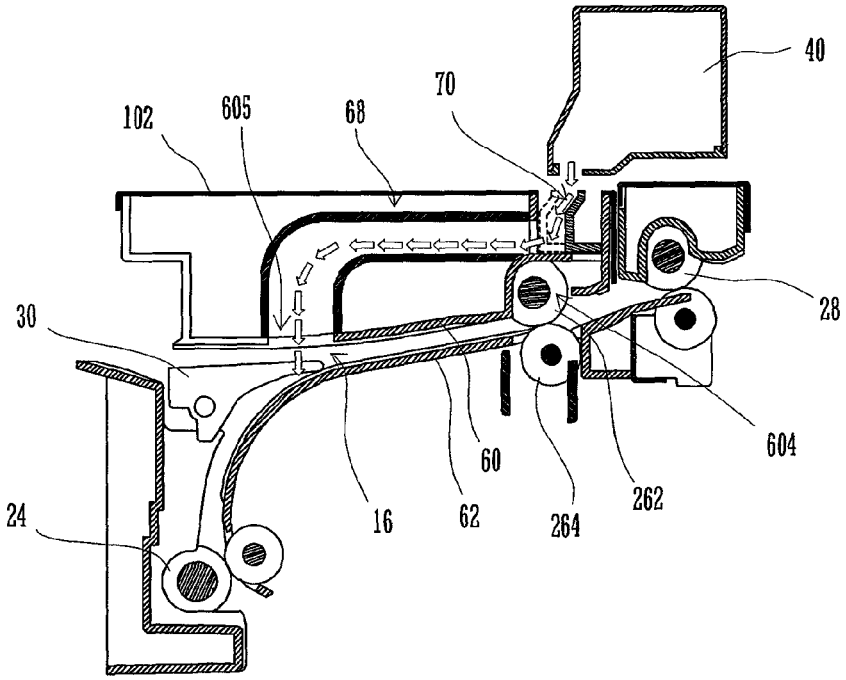

Furthermore, referring to FIG. 10A and FIG. 10B, another example of the configuration of a mechanism for cooling a sheet that has passed through the fixing device 22 is described. In the configuration shown in FIG. 10A and FIG. 10B, a valve member 70 which is configured so as to slide based on a control signal from the control portion 50 is provided.

The valve member 70 is configured so as to be slidably supported between the cooling fan 40 and the upper sheet guide 60 and to be applied by force by a solenoid which is operated by a control signal from the control portion 50. It should be understood that the mechanism for applying the force by which the valve member 70 is moved is not limited to a mechanism using a solenoid, and it is possible to use a mechanism using a linear motor and to adopt a cam mechanism and so on.

Additionally, in the vicinity of the valve member 70 and at the upper part of the upper sheet guide 60, a guide duct 68 configured so that the cooling air generated in the cooling fan 40 may be guided to the ventilation portion 605 formed in the upper sheet guide 60.

In the configuration described above, when a sheet passes through the nip line of the driving roller 262 and the driven roller 264, the valve member 70 is moved to the left so that air can be ventilated from the cooling fan 40 downward in the direction of the driving roller 262 and the driven roller 264 (refer to FIG. 10A). On the other hand, when a sheet does not pass through the nip line of the driving roller 262 and the driven roller 264, or when a sheet is in a standby state, in order to cool the parts of the upstream sides of the lower sheet guide 62 and the upper sheet guide 60, the valve member 70 is moved to the right side, and the cooling air is guided to the upstream in the sheet conveyance path 16 through the guide duct 68 (refer to FIG. 10B).

Here, as a part cooled by the cooling air, similar to the part in FIG. 6, FIG. 7, FIG. 8, and FIG. 9, it is preferred to introduce air near the leading edge of the flapper 30.

Figure 11:
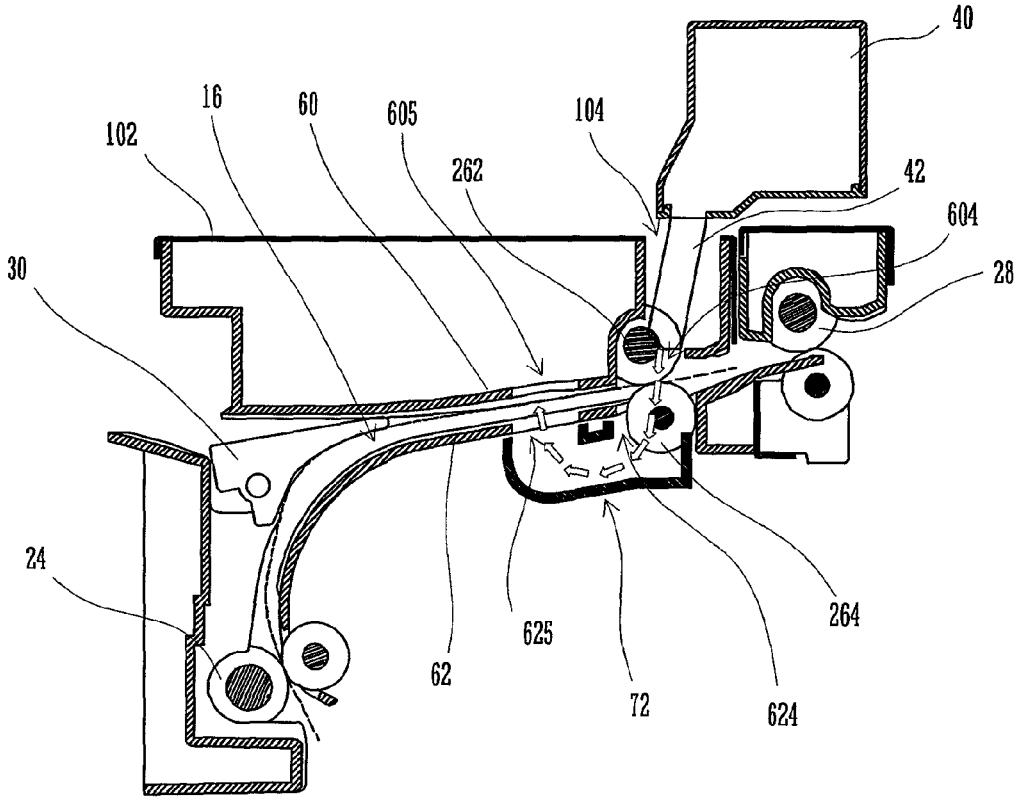
FIG. 11 is a cross-sectional view showing another exemplary configuration of a downstream side of a fixing device in a sheet conveyance path.

Subsequently, referring to FIG. 11, another example of the configuration of a mechanism for cooling a sheet that has passed through the fixing device 22 is described. In the configuration shown in FIG. 11, various methods are devised to surely prevent the fixing roller 222 and the pressure roller 224 in the fixing device 22 from being cooled by the cooling air generated by the cooling fan 40.

Specifically, in the lower part of the lower sheet guide 62, a guide duct 72 configured to be in a U shape so as to make the cooling air that has passed through the ventilation hole 624 do a U-turn upward is provided. At this time, the ventilation portion 625 in communication with the guide duct 72 is provided in the lower sheet guide 62. The ventilation portion 605 is also provided in a position opposed to the ventilation portion 625 in the upper sheet guide 60.

In the configuration described above, it becomes possible to press a sheet that passes toward the nip line of the driving roller 262 and the driven roller 264 against the upper sheet guide 60 by the cooling air that passes from the lower to the upper direction. As a result, it becomes possible to suppress the contact between an image formed on an under surface of a sheet and the lower sheet guide 62 to the necessary minimum, and toner becomes unlikely to adhere to the lower sheet guide 62.

Figure 12:
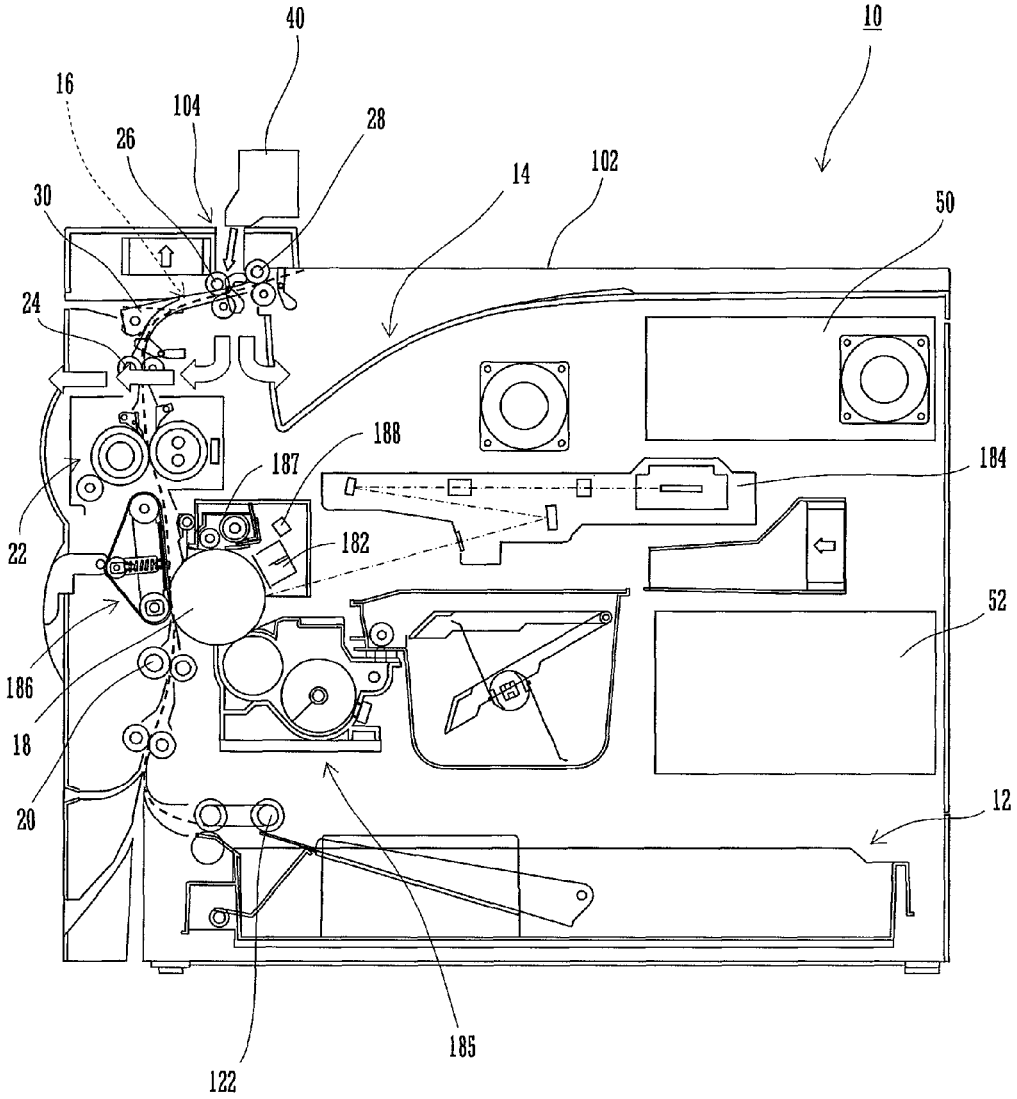
FIG. 12 is a cross-sectional view showing of another example of an image forming apparatus according to an embodiment of the present invention.

Although description has been made of the foregoing embodiments in which the cooling air generated by the cooling fan 40 is guided to various parts, in addition to foregoing embodiments, the cooling air can be made to pass through the inner side of a paper output frame and between the upper frames of the paper output tray 14 and the fixing device 22 as shown in FIG. 12, for example.

The above described embodiments are to be considered in all respects as illustrative and not restrictive. The scope of the present invention is defined not by above described embodiments but by the claims. Further, the scope of the present invention is intended to include all modifications that come within the meaning and scope of the claims and any equivalents thereof.

REFERENCE SIGNS LIST

10 image forming apparatus
16 sheet conveyance path
24 post-fixing roller
28 paper output roller
40 cooling fan
42 blowing duct
60 upper sheet guide

62 lower sheet guide
262 driving roller
264 driven roller
604 ventilation portion
624 ventilation portion

The invention claimed is:

1. An image forming apparatus configured to sequentially output a sheet having been subjected to image formation processing to a paper output tray, comprising:

a sheet conveyance path formed between a paper feed tray and the paper output tray;

a heat-treatment portion configured so as to heat-treat a sheet being conveyed along the sheet conveyance path;

a pair of conveyance rollers disposed downstream of the heat-treatment portion in the sheet conveyance path and configured so as to convey the sheet having passed the heat-treatment portion in a direction of the paper output tray;

an outer sheet guide and an inner sheet guide configured so as to define a downstream part of the heat-treatment portion in the sheet conveyance path; and a cooling device configured so as to cool down the sheet being conveyed between the outer sheet guide and the inner sheet guide by cooling air, wherein:

the outer sheet guide includes a ventilation portion in a position corresponding to a position of the conveyance rollers, the ventilation portion being configured so as to make the cooling air from the cooling device pass through;

the inner sheet guide includes a ventilation portion in a position opposed to a position of the ventilation portion of the outer sheet guide, the ventilation portion being configured so as to make the cooling air from the cooling device pass through; and a nip line is positioned in the sheet conveyance path more upstream than a flow path of the cooling air from the cooling device, the nip line being obtained by extending a nip portion of the pair of conveyance rollers in an axial direction of the pair of conveyance rollers.

2. The image forming apparatus according to claim 1, wherein the inner sheet guide has a plurality of ribs on an upstream side of the ventilation portion on a surface of the inner sheet guide, which contacts a sheet, the ribs extending along a sheet conveyance direction.

3. The image forming apparatus according to claim 1, further comprising a guide duct configured so as to guide the cooling air having passed through the ventilation portion of the inner sheet guide to an upstream side of the sheet conveyance path.

4. The image forming apparatus according to claim 3, wherein the guide duct is configured so as to guide the cooling air to a post-fixing roller disposed upstream of the conveyance rollers in the sheet conveyance path.

5. The image forming apparatus according to claim 3, wherein the guide duct is configured so as to guide the cooling air to the ventilation portion disposed upstream of the conveyance rollers in the inner sheet guide.

6. The image forming apparatus according to claim 1, further comprising: a guide duct configured so as to guide the cooling air generated from the cooling device to an upstream side in the sheet conveyance path; and a flow path switching mechanism capable of guiding the cooling air generated from the cooling device to either of the ventilation portion of the outer sheet guide or the guide duct selectively.

7. The image forming apparatus according to claim 3, further comprising a fixing device, wherein the cooling device is disposed opposed to the fixing device with the sheet conveyance path held therebetween.

8. The image forming apparatus according to claim 6, further comprising a fixing device, wherein the cooling device is disposed opposed to the fixing device with the sheet conveyance path held therebetween.

* * * * *